US006595110B1

(12) United States Patent
Huang

(10) Patent No.: US 6,595,110 B1
(45) Date of Patent: Jul. 22, 2003

(54) BLENDING AND BUBBLE FILTERING CONTAINER STRUCTURE

(76) Inventor: Chiu-Yun Huang, No. 20, Industrial Park 35Th. Road, Taichung City (TW)

( * ) Notice: Subject to any disclaimer, the term of this patent is extended or adjusted under 35 U.S.C. 154(b) by 0 days.

(21) Appl. No.: 10/238,102

(22) Filed: Sep. 10, 2002

(51) Int. Cl.[7] ..... A23L 1/00; A47J 31/18; A47J 43/28

(52) U.S. Cl. ..... 99/323; 99/494; 99/495; 30/326; 30/141; 206/216; 206/229; 206/572; 426/82; 426/110; 426/115

(58) Field of Search ..... 99/495, 494, 484, 99/275, 279, 323; 30/326, 141; 53/559; 206/5, 497, 568, 216, 219, 363, 229, 820, 572; 426/78, 86, 110, 112, 115, 120, 82, 134; 215/DIG. 5; 220/23.8; 229/123.1; D7/647, 653

(56) References Cited

U.S. PATENT DOCUMENTS 880,190 A * 2/1908 Von Bultzingslowen ..... 99/323
1,601,335 A * 9/1926 Addison ..... 83/659
3,154,418 A * 10/1964 Lovell et al. ..... 426/78
3,287,806 A * 11/1966 Kellerman ..... 206/229 X
3,360,121 A * 12/1967 Zoeller et al. ..... 206/216
3,428,460 A * 2/1969 Ely ..... 426/115 X
3,662,463 A * 5/1972 Ushkow et al. ..... 30/326
3,911,578 A * 10/1975 Ushkow et al. ..... 99/495 X
4,849,231 A * 7/1989 Spee ..... 426/87
4,891,232 A * 1/1990 Dahl ..... 426/78
4,956,917 A * 9/1990 Chung ..... 30/326
5,277,103 A * 1/1994 Cox ..... 99/323
5,906,845 A * 5/1999 Robertson ..... 99/495 X

* cited by examiner

*Primary Examiner*—Timothy F. Simone
(74) *Attorney, Agent, or Firm*—Connolly Bove Lodge & Hutz LLP

(57) ABSTRACT

A blending and bubble filtering container structure includes a spoon-shaped blending and bubble filtering container, and a filtering film layer bonded on the spoon-shaped blending and bubble filtering container. The spoon-shaped blending and bubble filtering container is formed with a receiving space and an air guide channel communicated with the receiving space. The filtering film layer is formed with an air vent communicating with the air guide channel, so that the blending bubbles contained in the spoon-shaped blending and bubble filtering container may be carried through the air guide channel and the air vent, and may be drained outward through the air vent.

4 Claims, 5 Drawing Sheets

BLENDING AND BUBBLE FILTERING CONTAINER STRUCTURE

BACKGROUND OF THE INVENTION

1. Field of the Invention

The present invention relates to a blending and bubble filtering container structure for food, seasoning or the like, and more particularly to a blending and bubble filtering container structure for food, seasoning or the like, wherein the blending bubbles contained in the spoon-shaped blending and bubble filtering container may be drained outward through the air vent of the filtering film layer easily and conveniently, thereby enhancing the blending and filtering effect of the disposable blending and bubble filtering container structure.

2. Description of the Related Art

A conventional portable and disposable food/seasoning bag or disposable infuser contains soluble food/seasoning including coffee powder, tea leaves, soy or other sauce. However, when such a flat shaped soft portable bag is torn out, the food/seasoning is not easily poured outward from the torn opening of the portable bag, thereby greatly causing inconvenience to the user when in use. In addition, the flat shaped soft portable bag is easily squeezed, thereby affecting its quality.

The closest prior art references of which the applicant is aware are disclosed in U.S. Pat. No. 3,154,418; U.S. Pat. No. 3,428,460; U.S. Pat. No. 3,287,806; U.S. Pat. No. 5,906,845; U.S. Pat. No. 3,360,121; and U.K. Patent No. 1601335.

SUMMARY OF THE INVENTION

The present invention has arisen to mitigate and/or obviate the disadvantage of the conventional portable and disposable food/seasoning bag or disposable infuser.

The primary objective of the present invention is to provide a blending and bubble filtering container structure for food, seasoning or the like, wherein by provision of the air vent of the filtering film layer and the air guide channel of the spoon-shaped blending and bubble filtering container, the blending bubbles contained in the spoon-shaped blending and bubble filtering container may be carried through the air guide channel of the spoon-shaped blending and bubble filtering container and the air vent of the filtering film layer, and may be drained outward through the air vent of the filtering film layer easily and conveniently, thereby enhancing the blending and filtering effect of the disposable blending and bubble filtering container structure.

In accordance with the present invention, there is provided a blending and bubble filtering container structure, comprising a spoon-shaped blending and bubble filtering container, and a filtering film layer, wherein:

the spoon-shaped blending and bubble filtering container has a side provided with a handle extending outward, the spoon-shaped blending and bubble filtering container has an open top wall provided with a top annular flange, the spoon-shaped blending and bubble filtering container is formed with a receiving space, the spoon-shaped blending and bubble filtering container is formed with an air guide channel located adjacent to the handle and communicated with the receiving space; and the filtering film layer is bonded on the top annular flange of the spoon-shaped blending and bubble filtering container in a sealing manner, the filtering film layer has one side formed with an air vent aligning and communicating with the air guide channel of the spoon-shaped blending and bubble filtering container, so that blending bubbles contained in the spoon-shaped blending and bubble filtering container may be carried through the air guide channel of the spoon-shaped blending and bubble filtering container and the air vent of the filtering film layer, and may be drained outward through the air vent of the filtering film layer.

Further benefits and advantages of the present invention will become apparent after a careful reading of the detailed description with appropriate reference to the accompanying drawings.

DETAILED DESCRIPTION OF THE INVENTION

Figure 1:
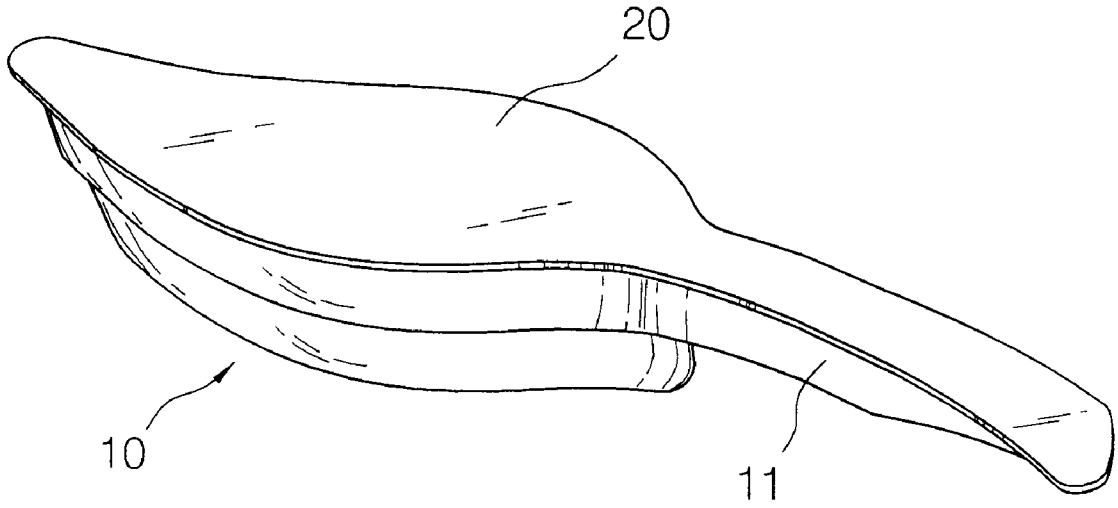
FIG. 1 is a perspective view of a blending and bubble filtering container structure for food, seasoning or the like in accordance with a preferred embodiment of the present invention.
Figure 2:
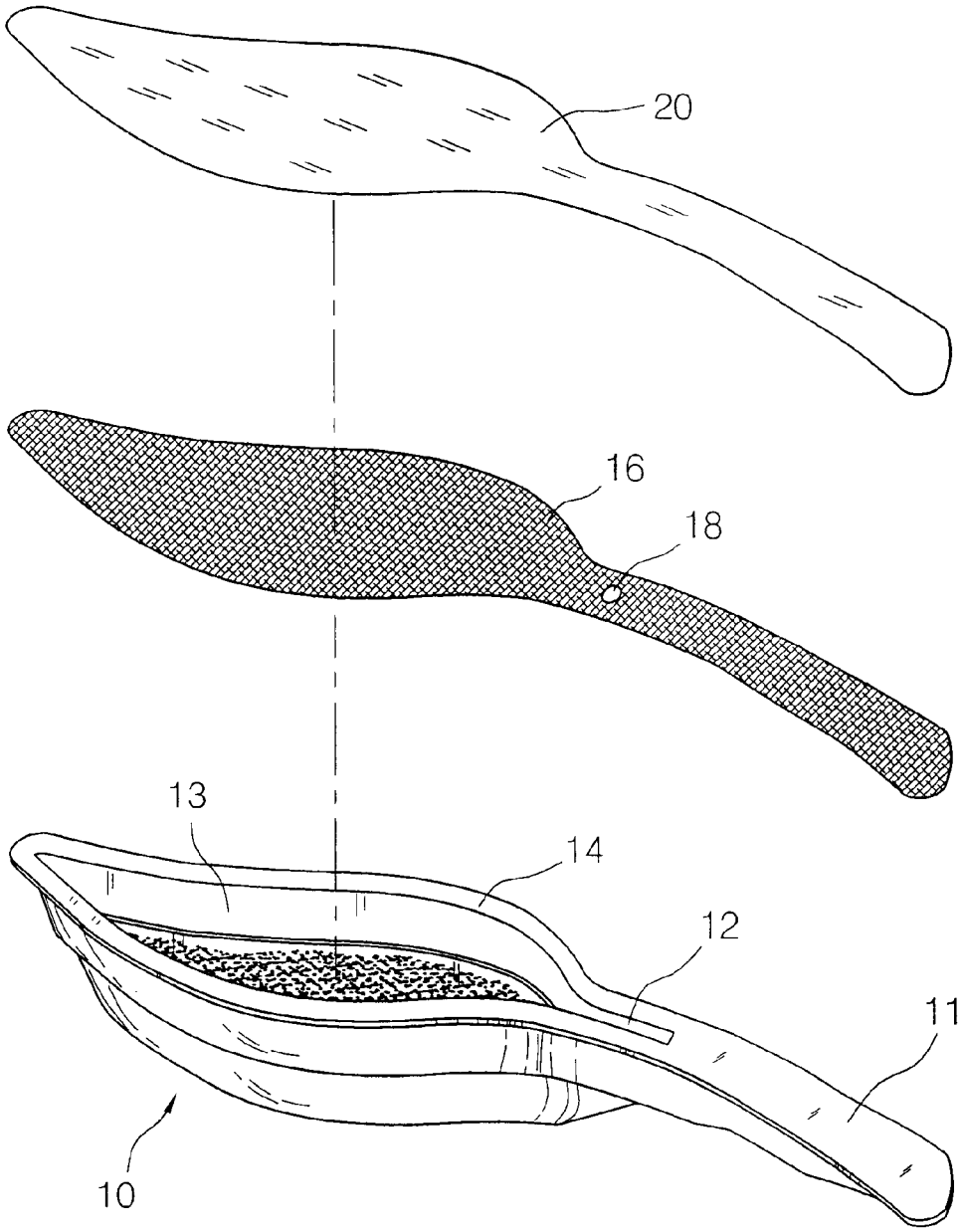
FIG. 2 is an exploded perspective view of the blending and bubble filtering container structure for food, seasoning or the like as shown in FIG. 1.
Figure 3:
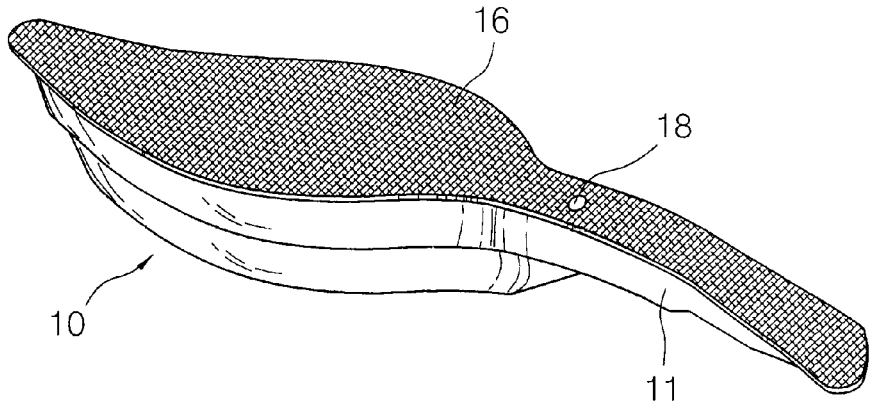
FIG. 3 is a perspective view of the blending and bubble filtering container structure for food, seasoning or the like in accordance with the preferred embodiment of the present invention, wherein the waterproof layer is removed.
Figure 4:
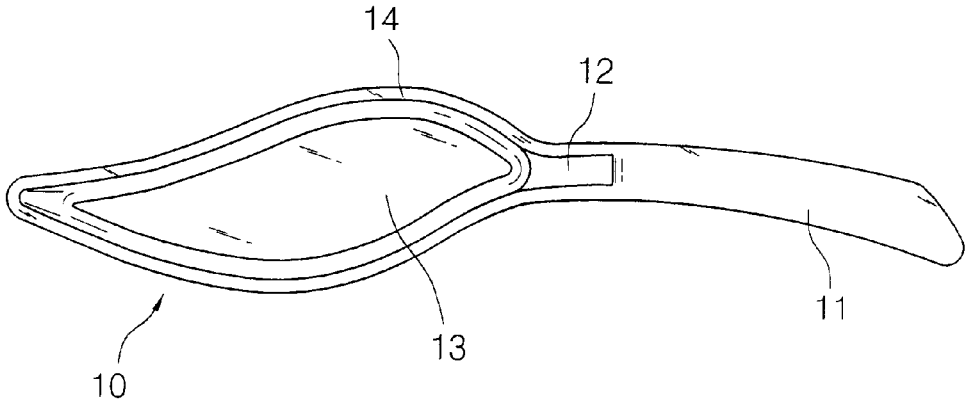
FIG. 4 is a top plan view of the spoon-shaped blending and bubble filtering container of the blending and bubble filtering container structure for food, seasoning or the like in accordance with the preferred embodiment of the present invention, wherein the waterproof layer is removed.

Referring to the drawings and initially to FIGS. 1–5, a disposable blending and bubble filtering container structure for food, seasoning or the like in accordance with a preferred embodiment of the present invention comprises a spoon-shaped blending and bubble filtering container 10, a filtering film layer 16, and a waterproof layer 20.

The spoon-shaped blending and bubble filtering container 10 has a side provided with a handle 11 extending outward. The spoon-shaped blending and bubble filtering container 10 has an open top wall provided with a top annular flange 14. The spoon-shaped blending and bubble filtering container 10 is formed with a receiving space 13 for receiving dissolvable food, seasoning or the like therein, such as coffee powder, milk scream, tea, sauce or the like. The spoon-shaped blending and bubble filtering container 10 is formed with an oblique air guide channel 12 located adjacent to the handle 11 and communicated with the receiving space 13.

Figure 5:
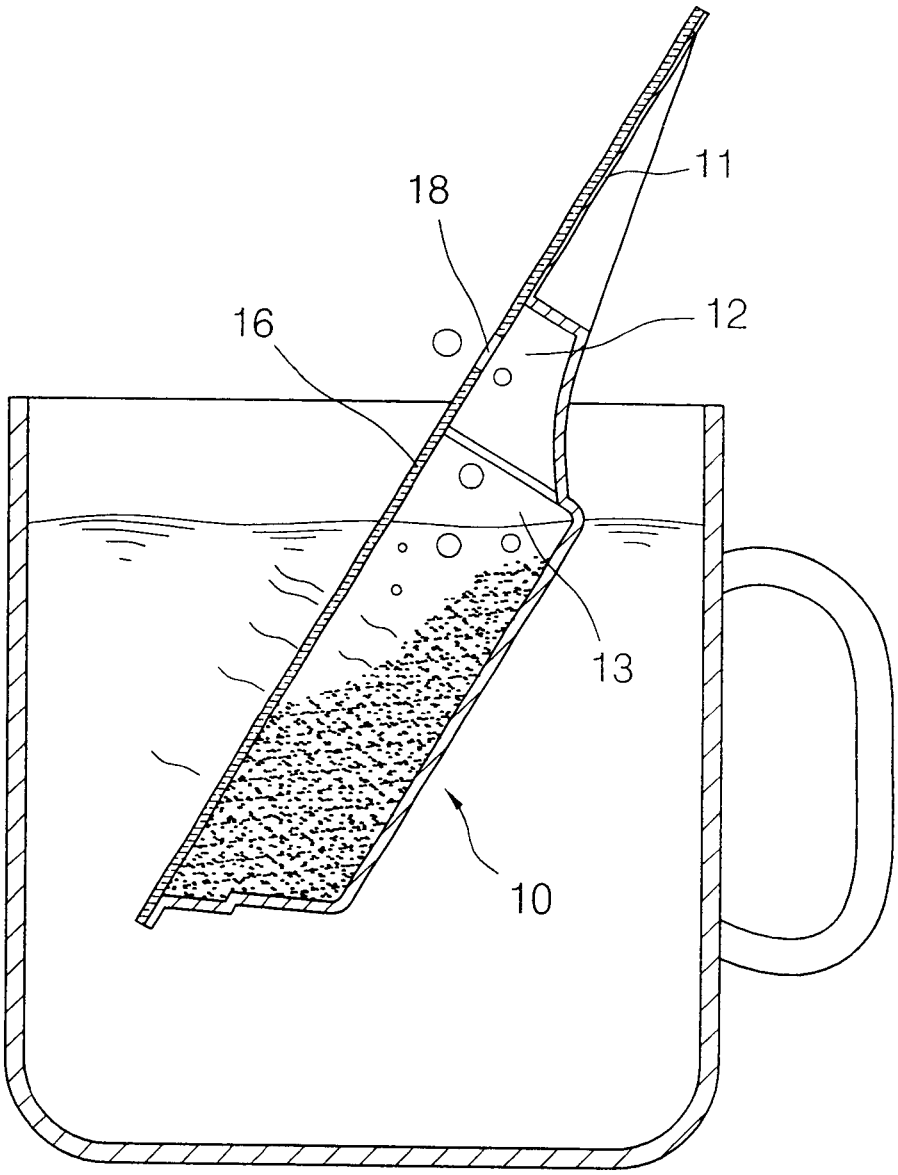
FIG. 5 is a schematic side plan cross-sectional operational view of the blending and bubble filtering container structure for food, seasoning or the like as shown in FIG. 3 in use.

The filtering film layer 16 is bonded on the top annular flange 14 of the spoon-shaped blending and bubble filtering container 10 in a sealing manner, so that the food or seasoning may be sealed in the receiving space 13 of the spoon-shaped blending and bubble filtering container 10, thereby preventing the food or seasoning from falling out of the receiving space 13 of the spoon-shaped blending and bubble filtering container 10. In addition, the filtering film layer 16 may be used to filter and isolate the food or seasoning contained in the receiving space 13 of the spoon-shaped blending and bubble filtering container 10. The filtering film layer 16 has one side formed with an air vent 18 aligning and communicating with the air guide channel 12 of the spoon-shaped blending and bubble filtering container 10, so that the blending bubbles contained in the spoon-shaped blending and bubble filtering container 10 may be carried through the air guide channel 12 of the spoon-shaped blending and bubble filtering container 10 and the air vent 18 of the filtering film layer 16, and may be drained outward through the air vent 18 of the filtering film layer 16 conveniently as shown in FIG. 5. It is appreciated that, when the liquid is bonded on the surface of the filtering film layer 16, the filtering film layer 16 is easily blocked and choked, so that the blending bubbles contained in the spoon-shaped blending and bubble filtering container 10 cannot be drained outward through the filtering film layer 16 easily. Thus, by provision of the air vent 18 of the filtering film layer 16, the blending bubbles contained in the spoon-shaped blending and bubble filtering container 10 may be carried through the air guide channel 12 of the spoon-shaped blending and bubble filtering container 10 and the air vent 18 of the filtering film layer 16, and may be drained outward through the air vent 18 of the filtering film layer 16 easily and conveniently as shown in FIG. 5, thereby enhancing the blending and filtering effect of the disposable blending and bubble filtering container structure.

The waterproof layer 20 is detachably stuck or bonded on the filtering film layer 16.

In practice, as shown in FIG. 5, the waterproof layer 20 can be removed from the filtering film layer 16, thereby exposing the filtering film layer 16 to the ambient environment. Then, the spoon-shaped blending and bubble filtering container 10 together with the filtering film layer 16 can be placed into a cup or the like so that the boiling water contained in the cup is allowed to enter the receiving spaces 13 of the spoon-shaped blending and bubble filtering container 10 through the filtering film layer 16 to mix with the food or seasoning, such as coffee powder, tea leaves, soy or other sauce. Then, the mixture of the boiling water and the food/seasoning can be evenly distributed in the spoon-shaped blending and bubble filtering container 10 by stirring and blending the water contained in the cup with the handle 11, thereby properly making the coffee, tea, soup or other beverage. The filtering film layer 16 can be used to filter the mixture flowing therethrough, thereby separating the solid particles that are not dissolved in the water such as the tea dregs or the like.

Figure 6:
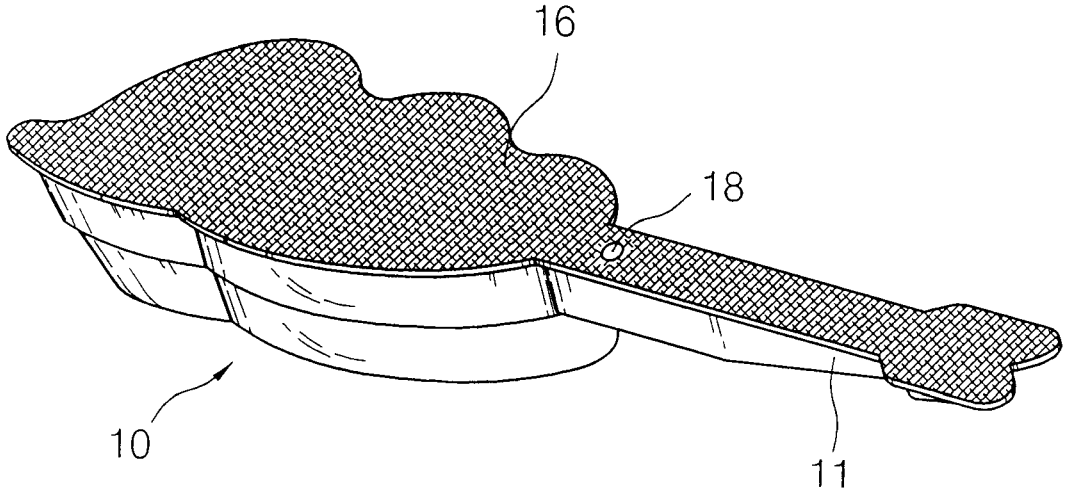
FIG. 6 is a perspective view of the blending and bubble filtering container structure for food, seasoning or the like in accordance with another embodiment of the present invention, wherein the waterproof layer is removed.

Referring to FIG. 6, a disposable blending and bubble filtering container structure for food, seasoning or the like in accordance with another embodiment of the present invention is shown, wherein both of the spoon-shaped blending and bubble filtering container 10 and the filtering film layer 16 have a violin-shaped configuration.

Accordingly, in the disposable blending and bubble filtering container structure for food, seasoning or the like of the present invention, by provision of the air vent 18 of the filtering film layer 16 and the air guide channel 12 of the spoon-shaped blending and bubble filtering container 10, the blending bubbles contained in the spoon-shaped blending and bubble filtering container 10 may be carried through the air guide channel 12 of the spoon-shaped blending and bubble filtering container 10 and the air vent 18 of the filtering film layer 16, and may be drained outward through the air vent 18 of the filtering film layer 16 easily and conveniently as shown in FIG. 5, thereby enhancing the blending and filtering effect of the disposable blending and bubble filtering container structure.

In addition, the filtering film layer 16 can be used to seal and package the spoon-shaped blending and bubble filtering container 10 into an integrity. In such a manner, the spoon-shaped blending and bubble filtering container 10 can be used to protect the food/seasoning contained therein, and to prevent from squeezing or squashing the food/seasoning filled therein. further, the filtering film layer 16 can be used to filter and separate the solid particles or dregs that are not dissolved in the water. Further, the waterproof layer 20 made of foil can be used to protect the corresponding receiving space 13, thereby preventing the receiving space 13 from exposing to the ambient environment.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A blending and bubble filtering container structure, comprising a spoon-shaped blending and a bubble filtering container, and a filtering film layer, wherein:

the spoon-shaped blending and bubble filtering container has a side provided with a handle extending outward, the spoon-shaped blending and bubble filtering container has an open top wall provided with a top annular flange, the spoon-shaped blending and bubble filtering container is formed with a receiving space, the spoon-shaped blending and bubble filtering container is formed with an air guide channel located adjacent to the handle and communicated with the receiving space; and the filtering film layer is bonded on the top annular flange of the spoon-shaped blending and bubble filtering container in a sealing manner, the filtering film layer has one side formed with an air vent aligning and communicating with the air guide channel of the spoon-shaped blending and bubble filtering container, so that blending bubbles contained in the spoon-shaped blending and bubble filtering container may be carried through the air guide channel of the spoon-shaped blending and bubble filtering container and the air vent of the filtering film layer, and may be drained outward through the air vent of the filtering film layer.

2. The blending and bubble filtering container structure in accordance with claim 1, further comprising a waterproof layer detachably stuck or bonded on the filtering film layer.

3. The blending and bubble filtering container structure in accordance with claim 1, wherein the air guide channel is arranged in an oblique manner.

4. The blending and bubble filtering container structure in accordance with claim 1, wherein both of the spoon-shaped blending and bubble filtering container and the filtering film layer have a violin-shaped configuration.

* * * * *